US005371977A

United States Patent [19]

Liner

[11] Patent Number: 5,371,977

[45] Date of Patent: Dec. 13, 1994

[54] PORTABLE, IN-PLACE SHARPENER FOR LAWN MOWER BLADES AND THE LIKE

[76] Inventor: Christopher A. Liner, 120 Southdown W. Blvd. Apt. 8, Houma, La. 70360

[21] Appl. No.: 107,941

[22] Filed: Aug. 17, 1993

[51] Int. Cl.[5] ..... B24B 3/42; B24B 23/00; B24B 41/00; B24B 55/05

[52] U.S. Cl. ..... 451/349; 76/82.1; 451/262; 451/293; 451/451

[58] Field of Search ..... 51/111 R, 112, 111 BR, 51/109 BS, 158, 159, 254, 247, 285, 326, 327, 204, 206 R, 205 R, 268, 270, 272, 273, 173; 76/82.1

[56] References Cited

U.S. PATENT DOCUMENTS

| | | | |
|---|---|---|---|
| 1,491,079 | 4/1924 | Champion | 51/206 R |
| 1,918,575 | 7/1933 | Van Berkel | 51/111 |
| 1,977,088 | 10/1934 | Richardson | 51/273 |
| 2,921,416 | 1/1960 | Shanahan . | |
| 2,993,312 | 7/1961 | Holland et al. | 51/173 |
| 3,019,568 | 2/1962 | Sauers et al. . | |
| 3,122,865 | 3/1964 | Kolling | 31/173 |
| 3,238,673 | 3/1966 | Thompson . | |
| 3,514,906 | 6/1970 | Everett | 51/273 |
| 3,585,980 | 6/1971 | Mellor | 51/273 |
| 3,648,414 | 3/1972 | Thompson . | |
| 3,800,480 | 4/1974 | Keating . | |
| 5,172,680 | 12/1992 | Swan | 51/273 |

*Primary Examiner*—Jack W. Lavinder
*Attorney, Agent, or Firm*—C. Emmett Pugh

[57] ABSTRACT

A blade sharpening device (8) easily connectable to a source of rotating power, such as a battery powered hand drill (66), and having a guard member (14), a selectably locatable handle member (16/16') attached to the guard member, and hand-manipulatable means for maintaining the grinding surfaces of the sharpening device at a desired grinding angle and moving it along the length of the blade edge. The guard extends completely over the width of the rotatable sharpening members (10 & 58) and over about eighty (80°) degrees or approximately a quadrant (ninety degrees) of their sides and provides an upper, curved surface (18) or a side, flat surface (19), depending on which handle location (30/28) is used, against which the user's hand can be rested for greater control and stability of the sharpener when in use on, for example, a lawn mower blade (62) which is still attached to the lawn mower drive shaft (63) at the underside of the lawn mower housing (64). This on-site, in-place blade sharpening capability eliminates the necessity of removing the blade for its sharpening, while still allowing easy and safe sharpening of the blade even in such awkward circumstances.

15 Claims, 3 Drawing Sheets

PORTABLE, IN-PLACE SHARPENER FOR LAWN MOWER BLADES AND THE LIKE

TECHNICAL FIELD

The present invention is directed to blade sharpening devices in general and more particularly to blade sharpening devices suitable for on-site, in-place use on blades which are, for example, attached to a driving member, such as, for example, a lawn mower blade, and even more particularly to such a device which has a safety guard and associated means for allowing the operator to manually control the positioning and movement of the sharpening device. In additional to the preferred, exemplary application of lawn mower blades, the device can be used to sharpen other devices, such as, for further example, garden tillers, shovels, hoes, as well as scythes, cane knives, sweepers, bladed "weed eaters", bush hogs, etc.

BACKGROUND ART

It is often the case with a mechanically powered blade, such as the blade of a conventional rotary mower, that from time-to-time the edge of the blade will require sharpening. The sharpening of the blade edge increases the cutting efficiency of the blade by allowing the edge of the blade to cut the item intended instead of tearing the item as a blunt edge will do.

One problem with maintaining a sharp edge on such a blade is the inconvenience involved in removing the blade from its driving member in order to sharpen the blade on a blade sharpening device, such as, for example, a bench mounted grinding wheel. It would be better, therefore, to have a blade sharpening device which is portable and capable of use on the blade in-place, while the blade remains attached to its driving member.

There are many portable devices known. However there remains problems with such devices due to, inter alia, problems of safety, the ability to monitor the edge sharpening while it is in progress, and accuracy in controlling the angle of the edge being ground.

A list of prior patents which may be of interest is provided below:

| U.S. Pat. No. | Inventor | Issue Date |
|---|---|---|
| 2,921,416 | P. T. Shanahan | 01/19/60 |
| 2,993,312 | H. L. Holland et al | 07/25/61 |
| 3,019,568 | M. M. Sauers et al | 02/06/62 |
| 3,122,865 | H. W. Kolling | 03/03/64 |
| 3,238,673 | W. F. Thompson | 03/08/66 |
| 3,648,414 | W. F. Thompson | 03/14/72 |
| 3,800,480 | F. J. Keating | 04/02/74 |

U.S. Pat. No. 2,921,416 to Shanahan discloses a "lawn mower sharpener" in which a power drill is held upside-down in a cradle-type holder driving a grinding wheel 23, in which the holder includes positioning extensions or protuberances 26 & 27 which directly contact the lawn mower blade 26 and bed plate 28, respectively, causing the device to be directly carried by the blade and its associated structure. Such a device is very limited in its application being confined to use basically only with the lawn mower design illustrated and can be relatively dangerous to use, with the rotating grinder being exposed to the user during use.

U.S. Pat. No. 2,993,312 to Holland et al discloses a blade sharpening device, which is completely hand manipulated. The sharpener is powered by a portable power tool, and has a wheel type grinding stone rigidly secured to a shaft and a frustro-conically shaped guide which is rotatably mounted on the shaft adjacent to the grinding stone. The shaft is connectable to the chuck of a portable power tool. The wheel and the frustro-conically shaped guide are arranged on the shaft with the smaller end of the guide adjacent to the wheel type stone to present a fixed angular grinding surface to a blade held against the guide. The device includes no guard for the rotating sharpening members, making it relatively dangerous, and no means are provided to allow the user to grasp the device at both ends, making it more difficult to use and accurately position.

U.S. Pat. No. 3,019,568 issued Feb. 6, 1962 to Sauers et al discloses a lawn mower grinder and sharpener for a reel type lawn mower in which the sharpener is braced (17/18) on one of the lawn mower's basic structural components, i.e. the spacer rod 15. As above, this approach of direct bracing on the lawn mower structure greatly limits the applicability and use of the device. Also, as above, the substantial exposure of the rotating sharpening device to the user makes the device relatively dangerous to use.

U.S. Pat. No. 3,122,865 issued Mar. 3, 1964, to Kolling discloses a power tool attachment for the sharpening of rotary mower blades. The attachment includes a guide that is spaced from the grinding surface and means for adjusting the spacing between the guide and the grinding surface by disassembling the sharpening device and removing a spacing element, thereby, allowing the use of an unused portion of the grinding surface when a portion of the grinding surface becomes worn. Like Holland et al, the Kolling device includes no guard for the rotating sharpening member, making it relatively dangerous to use, and no means are provided to allow the user to grasp the device at both ends, making it more difficult to use and accurately position.

U.S. Pat. No. 3,238,673 issued Mar. 8, 1966, to W. F. Thompson discloses a non-portable, blade sharpener having a rotary guide for maintaining the angle of the blade in relation to a rotating, flat, grinding surface, wherein the guide includes protrusions which cause the blade to move radially, in an upward and downward direction, against the rotating grinding surface. This patent is not directly relevant to the field of the invention and does not help to overcome the deficiencies of the prior art discussed above and below.

U.S. Pat. No. 3,648,414 issued Mar. 14, 1972 also to W. F. Thompson discloses a scissor-type blade sharpener and likewise is not directly relevant to the field of the invention and does not help to overcome the deficiencies of the prior art discussed above and below.

U.S. Pat. No. 3,800,480 issued Apr. 2, 1974, to Keating discloses a portable, on-site, in-place blade sharpener which includes an angular drive means mounted in a housing containing an enclosed, dedicated, electric motor, with the device being hand-manipulated by the user grasping the motor housing 14 by itself or in conjunction with the sharpener housing 19 and moving the device along the blade edge. The angular drive means is connected between the electric motor 21 and a grinding wheel 35 for coupling the rotational energy of the internal motor to the grinding wheel. Such an approach, in which the device rides through a guide plate 11 in flat-face-to-flat-face surface engagement with the underside of the blade and which does not use a multi-purpose electric drill but rather a contained, dedicated motor, is relatively inflexible in its use and relatively expensive. It does not provide freedom of lateral or angular movement, nor the easily controllable and strongly grippable handle of a power drill, all of which can assist in the easy and accurate positioning of the rotating sharpening member on the blade.

As will be understood from the discussions below, the present invention overcomes the above detailed deficiencies of the prior art and substantially improves upon the prior art by providing an on-site, in-place, portable blade sharpening device for lawn mower blades and the like using the standard type portable electric hand drill for power which device is hand-manipulated, adaptable for use with many different lawn mower designs, relatively safe in use, and easily, stably and accurately moved and positioned by the user using an easily maneuverable two-hand grasp at opposed ends of the combined device and drill.

GENERAL DISCUSSION OF INVENTION

It is thus an object of the present invention to provide a portable blade sharpening device for lawn mowers and the like which has a guard which will protect the operator from projectiles created during the sharpening process, as well as provide a good, gripping surface for one hand of the user to hold, position and move the device along the blade in the sharpening process, while the blade is still in place in its working position on the lawn mower or like machine.

It is another object of the present invention to provide a blade sharpening device which will increase the operator's control of and accuracy in the positioning of the grinding surface of the sharpening device on the blade during the sharpening process and does not require it to be braced against any part of the housing of the lawn mower or other such structural parts or machinery, which could limit its applicability.

It is still a further object of the present invention to provide a method of sharpening an edge on the blade of a lawn mower, while it is still attached to a drive member, which is easily implemented and reduces the risk of injury to the operator.

Accordingly, the present invention in its preferred embodiment is directed to a blade sharpening device including a guard preferably with top and side surfaces which extend over the complete axial width and cover over a substantial amount of the sides of the rotating sharpening member(s). This guard member not only protects the user from flying debris or fragments but also provides a safe area for the user to grasp in several different ways in manipulating the device. Additionally, a selectively located handle member having a multiplicity of possible positions or locations preferably is also included, further adding to the ease of control and positioning of the device.

The blade sharpening device further comprises a rotatable grinding member riding on a shaft member with a shank for connection to, for example, a portable hand drill for the driving of the grinding member. The grinding member preferably includes a longitudinal aperture there through, and grinding surfaces adapted to grind an edge of desired dimensions on the blade to be sharpened.

The shaft member, which is secured to the grinding member and has an end thereof adapted for connection with a source of rotational power, such as, for example, a battery or AC powered, electrical drill, is further associated with securing means for securing the grinding member through the longitudinal aperture to the shaft member, and first and second shaft portions adapted for rotation within a first and second receiving means. The grinding guard member includes the first and second receiving means and defines a grinding member cavity therein adapted to allow the grinding member to be drivingly rotated about the axis of the longitudinal aperture, when the grinding member is secured by the securing means to the shaft member and the first and second shaft portions are received within the first and second receiving means, in a manner such that a portion of the grinding member is surrounded by the grinding guard member.

The grinding member includes both a sloped or conically shaped member as well as an opposed flat member, with the two of them co-operating together to mutually position and sharpen the blade. Alternatively, two opposed, sloped or conically shaped members could be used for dual-edge sharpening, depending on the type of device or blade being sharpened.

In use the user grips the handle of the drill with one hand and the other hand grips the housing and/or the handle attached to the guard or housing. The drill is then activated by depressing the drill's trigger, and the rotating sharpener is positioned on and moved along the blade using the guard member to accurately position and move the device longitudinally along the blade edge, appropriately sharpening it, while the guard also protects the user from any flying debris generated in the sharpening process.

The present invention thus provides an on-site, in-place, portable blade sharpening device for lawn mower blades and the like, preferably using the standard type portable electric hand drill for power, which device is hand-manipulated, adaptable for use with many different lawn mower designs, as well as many other devices, relatively safe in use, and easily, stably and accurately moved and positioned by the user using an easily maneuverable, two-hand grasp at opposed ends of the device and drill. In addition to the particularly perferred application of lawn mower blades, the device of the invention can be used to sharpen other devices, such as, for further example, garden tillers, shovels, hoes, as well as scythes, cane knives, sweepers, bladed "weed eaters", bush hogs, etc., particularly for the latter, where the grinding member includes two, opposed, conically shaped members.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
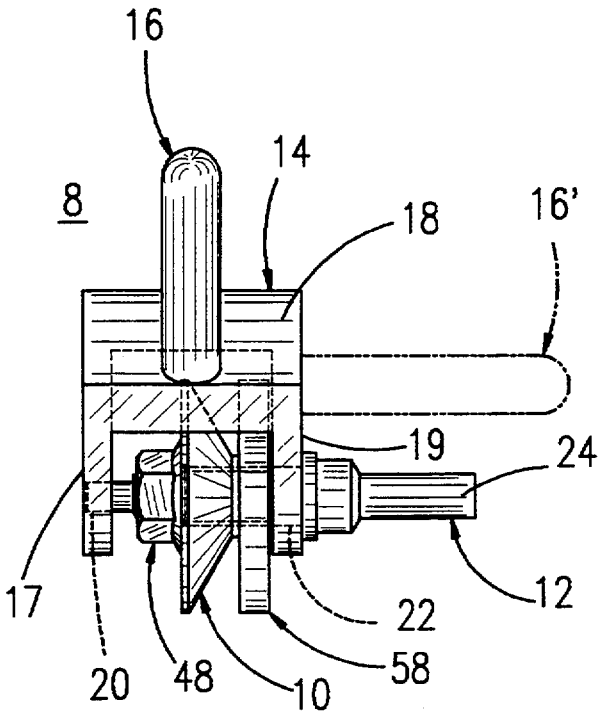
FIG. 1 is a side view of a preferred embodiment of the invention with the alternate position of the handle member again being shown in phantom line.

FIG. 1 shows the preferred, exemplary embodiment of the blade sharpening device of the invention with the main elements of the device including a grinding member, generally indicated by the numeral 10; a shaft member, generally indicated by the numeral 12; a grinding guard member, generally indicated by the numeral 14 and which can be transparent if so desired; and a handle member, generally indicated by the numeral 16 mounted to an upper, bridging surface 18. FIG. 1 also shows an alternate position (note 16') for mounting the handle member 16 to an outer, side surface 19 of the grinding guard member 14. First receiving means 20 and second receiving means 22 in the housing or guard member 14 for the shaft 12 can also be seen, although, they are better illustrated in FIG. 3.

The shaft member 12 may be constructed of any material which has sufficient torsional strength to rotate and carry the grinding member 10. Suitable shaft constructing materials include metals, such as steel, and plastics having the required torsional strength. In the preferred embodiment shaft member 12 is constructed of plastic nylon. The shaft member 12 includes an external shaft end or shank 24, which is adapted for connection with a source of rotational power, such as, for example, a battery or AC powered hand drill 66 (see FIG. 6).

In the preferred, exemplary embodiment the shaft end 24 is three-eighths (⅜") of an inch in diameter in order to fit within the chuck of an exemplary three-eighths (⅜") inch drill. However, the invention contemplates all of those methods, well known in the art, of connecting a shaft to a source of rotational power.

Figure 2:
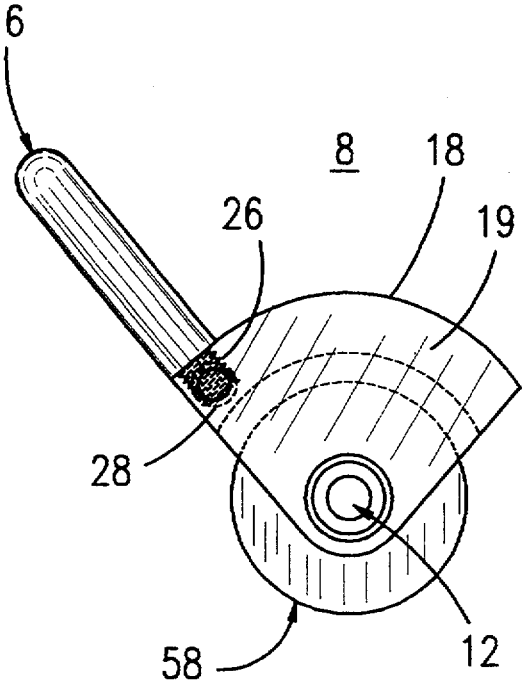
FIG. 2 is an axial view from the end the shaft member adapted for connection with a source of rotational power.

The present invention contemplates the fullest extent of coverage of the grinding cone member 10 by the grinding guard 14 possible, while still maintaining the blade sharpening capability of the grinding member 10. FIG. 2 shows an axial view from shaft end 24. It illustrates the preferred exemplary percentage of coverage of the grinding member 10 by the grinding guard member 14. In this preferred embodiment, the grinding guard member 14 covers about eighty (80°) degrees or approximately about twenty five (25%) percent of the grinding member 10.

Figure 4:
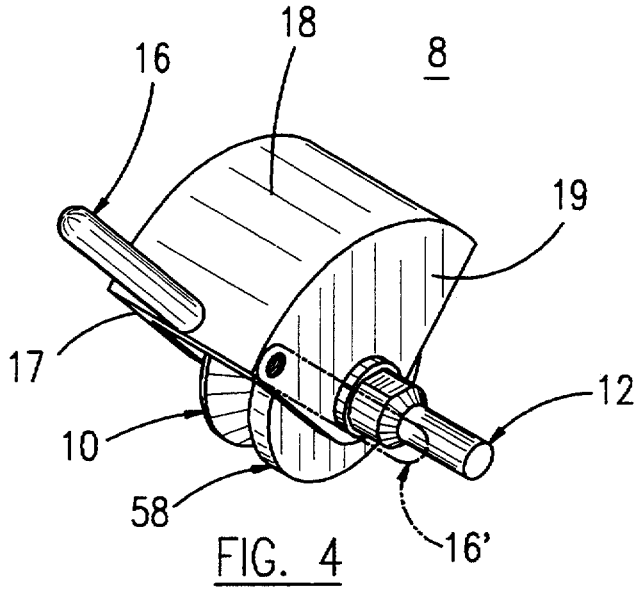
FIG. 4 is a perspective view of the over-all embodiment showing a preferred means of detachably mounting a handle and threaded means in the grinding guard member for allowing detachable mounting in preferred locations, with the alternate position of the handle member again being shown in phantom line.

Also shown, is a preferred, threaded method of attaching the handle member 16 to the grinding guard member 14. Although any known method of rigidly, mounting a handle to a surface is contemplated by the present invention, in this preferred embodiment, end 26 of handle member 16 is threaded and grinding guard member 14 includes companionately threaded, alternate bores 28 and 30. These are more clearly shown in FIG. 4.

Figure 3:
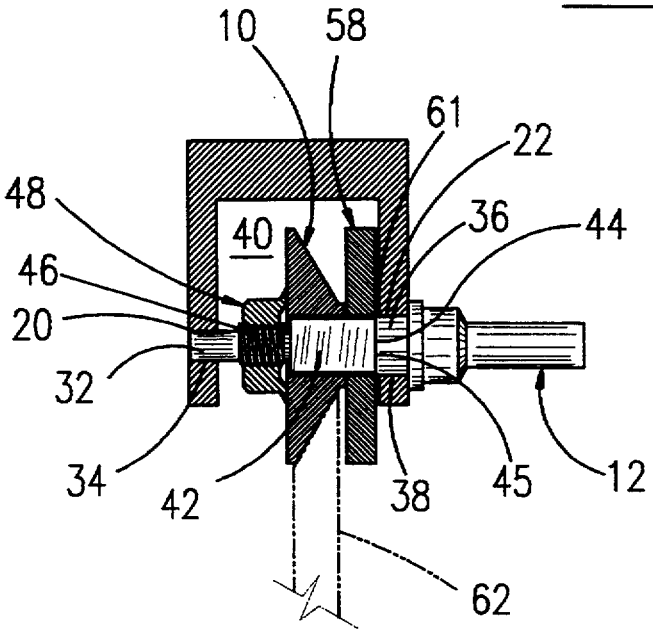
FIG. 3 is a cross-sectional side view illustrating the threaded section and the grinding stop member.

FIG. 3 is a longitudinal cross-section of the preferred, exemplary embodiment of the invention through the axis of shaft member 12. It shows a preferred first shaft portion 32, received within a preferred first receiving means 34, and a preferred second shaft portion 36, received within a preferred second receiving means 38. In this preferred embodiment first and second shaft portions 32 and 36 are cylindrically shaped and coaxially centered with the longitudinal axis of shaft member 12. First and second receiving means 34 and 38 are also cylindrically shaped and coaxially centered along a common axis, which is located to allow rotational clearance within grinding member cavity 40 for grinding member 10 mounted on shaft member 12.

The diameters of the first and second receiving means 34 and 38 are sufficiently larger than the diameters of the first and second shaft portions 32 and 36, respectively, to allow sufficient clearance for their rotation when received therein. In this preferred, exemplary embodiment this clearance is about two thousandths (0.002") of an inch. Although other means for easing the rotation of first and second shaft portions 32 and 36 are contemplated, such as inclusion of bearings, the mere application of a lubricating grease to the shaft portions and receiving means is simply, less expensive and currently preferred.

Figure 5:
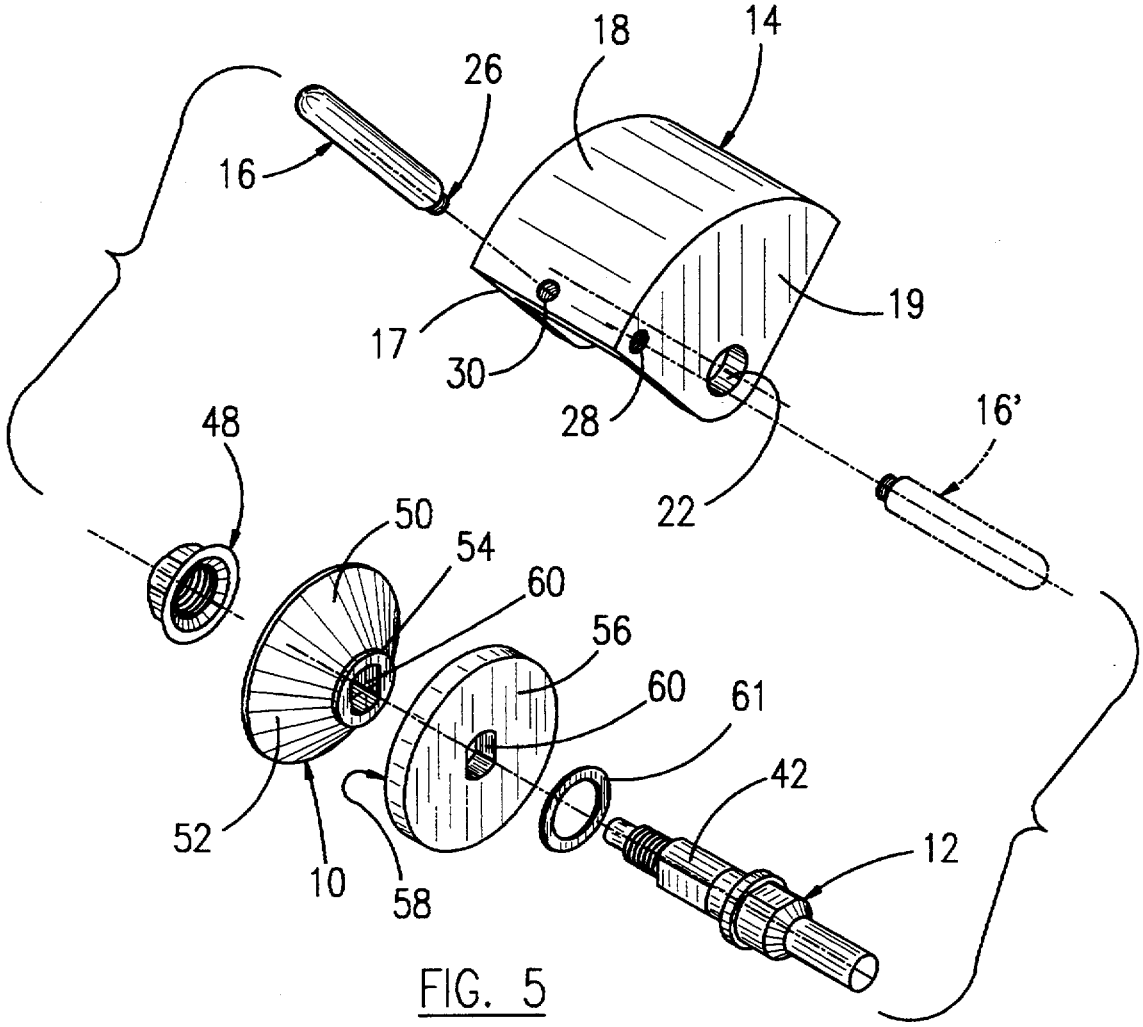
FIG. 5 is an exploded view of the device showing a preferred shaft and grinding member and a preferred mode of securing them together.

Receiving section 42 of the shaft member 12 is shown adjacent to the second shaft portion 36. The diameter of the receiving section 42 is smaller than the diameter of the second shaft portion 36 in order to allow the side 44 of the second shaft portion 36 to operate as a grinding member stop 45. A preferred means of securing the grinding member 10 to the shaft member 12 is accomplished by the combination of receiving section 42, grinding member stop 45, threaded section 46, and jam nut 48. A washer 61 is also preferably included. FIG. 5 is an exploded view showing their connection.

In this preferred, exemplary embodiment grinding member 10 is constructed of two, opposed, co-operating grinding stones 50 & 58, one being conical and the other being disc shaped, respectively. Grinding stone 50 includes a conically shaped grinding surface 52 and a small, cylindrically shaped grinding surface 54. Grinding stone 58 has a planar grinding surface (like surface 58) on the planar face not shown in the figure. Alternatively, the disc shaped member 58 could be replaced by another, opposed, conically shaped grinding stone, configured as a mirror image of grinding stone 50.

Also illustrated in FIG. 5 is a preferred means of imparting rotational energy from shaft member 12 to grinding member 10. This is accomplished by shaping the longitudinal aperture 60 of grinding member 10 to companionately mate with receiving section 42. Although any shape which will prevent the grinding member 10 from rotating freely about the receiving section 42 is contemplated by the invention, in this preferred embodiment a rectangular shape having opposes arcuate ends is used.

Figure 6:
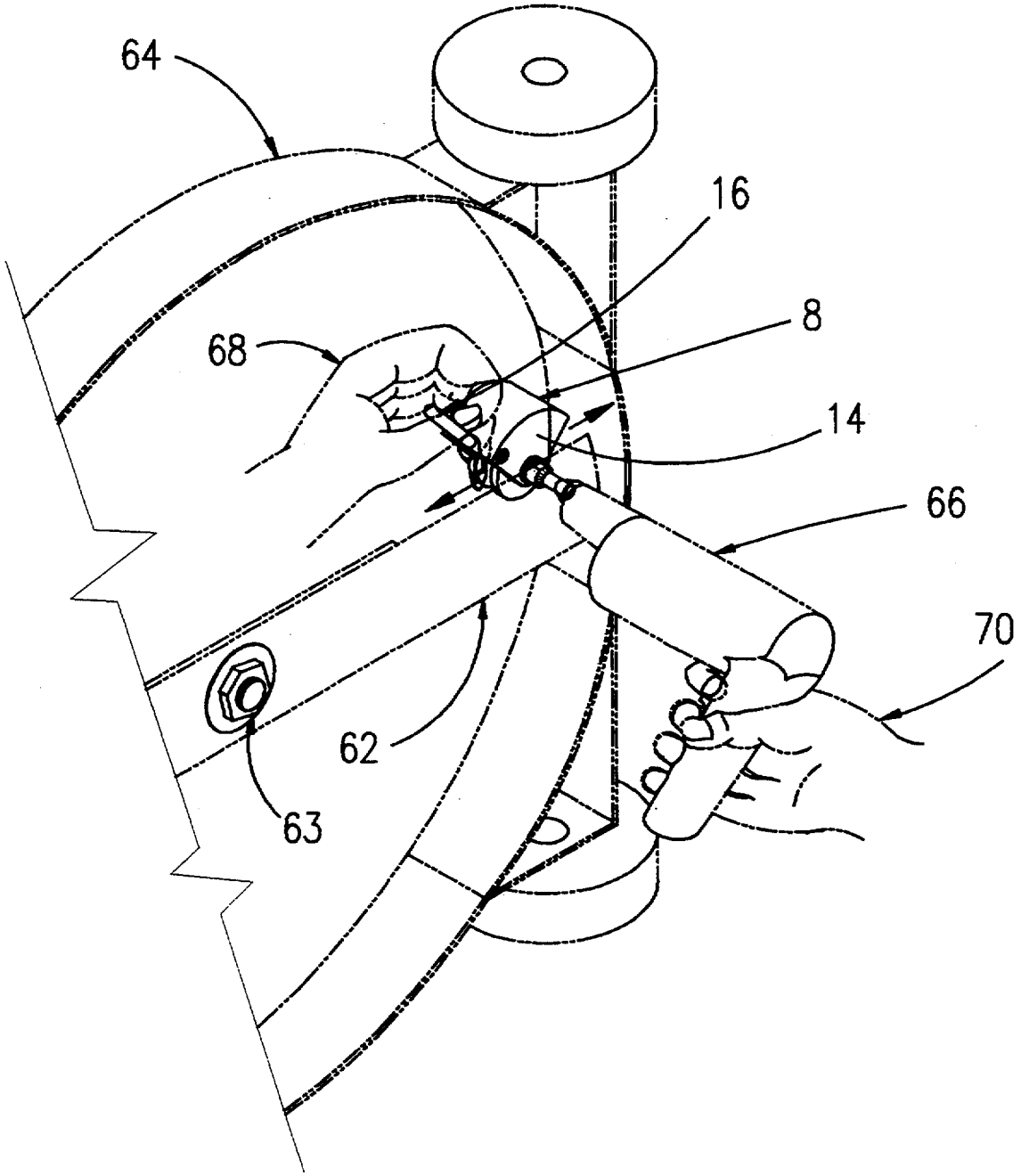
FIG. 6 is an underside perspective view of the preferred sharpening device illustrated in use on a conventional rotary lawn mower blade with the sharpening device being completely manually supported and guided with the exemplary lawn mower blade and body and the battery power drill all being shown in phantom line.

FIG. 6 illustrates the blade sharpening device 8 of the invention in use on the blade 62 of a conventional rotary lawn mower 64. It shows the blade sharpening device 8 connected to a source of rotational power, in this case a conventional portable drill 66. The sharpening device 8 is controlled by the operator by grasping handle member 16 with one hand 68 and the drill 66 with the other hand 70 as the device 8 is properly positioned and angled on the blade and is moved longitudinally along with extent of the blade's cutting edge. This arrangement gives the operator better control over the position of grinding member 10 on blade 62 by providing dual control locations and does not require the sharpening device be braced or supported on the machinery or housing which carries the blade 62.

The operational position of grinding guard member 14 is also illustrated. The relatively complete and full coverage of grinding member 10 by grinding guard member 14 affords the operator protection from flying debris created during the sharpening process and also provides a handy surface upon which the lower part of the hand and the side of the little finger can be rested. Alternatively, the guard member can be directly gripped with or without the handle 16 by the user placing his palm and fingers either across or along the surface 18, whichever may be more comfortable under the surrounding circumstances.

Thus, in use, preferably after disconnecting the spark plug wire, the user grips the handle of the drill 66 with one hand 70 and the other hand 68 grips the guard housing 17–19 and/or the handle 16 attached to the guard or housing. The drill 66 is then activated by depressing the drill's standard trigger and the rotating sharpener members 10/58 is positioned on and moved along the blade 62, with the user using the guard member and drill to accurately position and move the device along the blade edge (note directional arrows in FIG. 6), appropriately sharpening it, while the guard 14 also protects the user from any flying debris generated in the sharpening process.

In additional to the preferred, exemplary application of lawn mower blades, the device can be used to sharpen other devices, such as, for further example, garden tillers, shovels, hoes, as well as scythes, cane knives, sweepers, bladed "weed eaters", bushhogs, etc.

It is noted that the embodiment described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A blade sharpening device, comprising:

a grinding member defining a longitudinal aperture there through, and having rotatable grinding surfaces adapted to grind an edge of desired dimensions on the blade;

a shaft member, secured to said grinding member, having an end thereof adapted for connection with a source of rotational power; securing means for securing said grinding member, through said longitudinal aperture, to said shaft member; and first and second shaft portions adapted for rotation within a first and second receiving means;

a grinding guard member including said first and second receiving means and defining a grinding member cavity therein adapted to allow said grinding member to rotate about the axis of said longitudinal aperture, when said grinding member is secured by said securing means to said shaft member and said first and second shaft portions are received within said first and second receiving means, in a manner such that a portion of said grinding member is surrounded by said grinding guard member and having means for allowing detachable mounting of a handle member; and a handle member, attached to said grinding guard member, having means for detachably mounting said handle member to said grinding guard member.

2. The blade sharpening device of claim 1, wherein said means for allowing detachable mounting of said handle member includes means for allowing said handle member to be mounted in more than one location on said grinding guard member.

3. The blade sharpening device of claim 2, wherein said handle member is detachably mountable perpendicularly to and parallel to the longitudinal axis of said longitudinal aperture of said grinding member.

4. The blade sharpening device of claim 3, wherein said means for detachably mounting said handle member includes a cylindrical bore and cylindrical portion which are companionately threaded.

5. The blade sharpening device of claim 4, wherein said handle member further includes a threaded cylindrical end portion and said grinding member includes a plurality of companionately threaded cylindrical bores that are open to an outer surface of said grinding guard member.

6. The blade sharpening device of claim 1, wherein between 20 and 70 percent of the outer perimeter of said grinding member is within said grinding member cavity when said blade sharpening device is in use.

7. The blade sharpening device of claim 6, wherein said grinding guard member is constructed of a nylon plastic.

8. The blade sharpening device of claim 7, wherein said grinding guard member is transparent.

9. The blade sharpening device of claim 1, wherein said grinding member includes:

a first grinding element defining a planar grinding surface having a perimeter, and a first central aperture there through which is perpendicular to said planar grinding surface, said perimeter lying at a first predetermined distance from the axis of said first central aperture;

a second grinding element having a cylindrical shape defining a second central aperture there through and including a grinding surface on a non-planar outer surface thereof, said grinding surface running parallel to the axis of said second central aperture and defined by a radius from the axis of said second central aperture less than said first predetermined distance; and a third grinding element having a frustro-conical shape defining a third central aperture there through and including a grinding surface on the non planar surface thereof, the perimeter of outer surface of the smaller diameter end of said third grinding element being defined by a radius from the axis of said third central aperture which is substantially equal to the radius of the second grinding element; and wherein said first, second and third central apertures are arranged in a manner to form said longitudinal aperture of said grinding member.

10. The blade sharpening device of claim 9, wherein said means for securing said grinding member to said shaft member is adapted to allow the detachable securing of said first, second and third grinding elements to said shaft member through said first, second and third central aperture.

11. The blade sharpening device of claim 10, wherein said second and third grinding elements are integrally formed.

12. The blade sharpening device of claim 10, wherein the shapes of said first, second and third central apertures, and a securing portion of said shaft member which remains within said first, second and third central apertures when said grinding member is secured to said shaft member, are adapted in a manner to allow said securing portion of said shaft member to directly impart rotational energy to said grinding member when said shaft member is rotated.

13. The blade sharpening device of claim 1, wherein said shaft member is constructed of a plastic nylon.

14. The blade sharpening device of claim 13, wherein said means for securing said grinding member includes:

a grinding member stop integrally formed with said shaft member, adjacent said end adapted for connection with a source of rotational power, said grinding member stop having dimensions sufficient to prevent said shaft member from passing entirely through said longitudinal aperture of said grinding member;

a threaded section, along a portion of said shaft member which is dimensioned to extend through said longitudinal aperture when said grinding member is positioned on said shaft member in contact with said grinding member stop; and a jam nut, companionately threaded with said threaded section in a manner to allow a side of said jam nut to contact said grinding member and press said grinding member between said grinding member stop and said jam nut.

15. A method of sharpening the blade of a lawn mower or the like while said blade remains attached to a drive member of said lawn mower or the like, said method comprising the steps of:

(a) attaching a blade sharpening device to an electrically powered, portable, multi-purpose, multi-use power source producing rotating movement, such as a portable power drill, which device includes a grinding member defining a longitudinal aperture there through, and grinding surfaces adapted to grind an edge of desired dimensions on said blade;

a shaft member, secured to said grinding member, having an end thereof adapted for connection with said power source; securing means for securing said grinding member, through said longitudinal aperture, to said shaft member; and first and second shaft portions adapted for rotation within a first and second receiving means; and a grinding guard member including said first and second receiving means and defining a grinding member cavity therein adapted to allow said grinding member to rotate about the axis of said longitudinal aperture, when said grinding member is secured by said securing means to said shaft member and said first and second shaft portions are received within said first and second receiving means, in a manner such that a portion of said grinding member is surrounded by said grinding guard member;

(b) grasping the guard member of said sharpening device in one hand and said portable power source in the other;

(c) adjusting the location of the grinding guard member to allow the grinding member access to said blade;

(d) positioning said grinding member on said blade in a desired location;

(e) initiating transmission of rotational power from said source of rotational power to said shaft and said grinding member; and (f) moving said sharpening device along the blade while said grinding member is in contact with said blade and while the position of said blade sharpening device is controlled by grasping said sharpening device and said portable power source.

* * * * *